US006478725B1

(12) United States Patent
Bengt et al.

(10) Patent No.: US 6,478,725 B1
(45) Date of Patent: Nov. 12, 2002

(54) SLITTING UNIT FOR CARTON BLANK PRODUCTION

(75) Inventors: Åsberg Bengt, Örebro (SE); Jan Andréasson, Örebro (SE)

(73) Assignee: Emba Machinery AB, Orebro (SE)

( * ) Notice: Subject to any disclaimer, the term of this patent is extended or adjusted under 35 U.S.C. 154(b) by 0 days.

(21) Appl. No.: 09/674,169

(22) PCT Filed: Apr. 28, 1999

(86) PCT No.: PCT/SE99/00697

§ 371 (c)(1),
(2), (4) Date: Nov. 29, 2000

(87) PCT Pub. No.: WO99/58321

PCT Pub. Date: Nov. 18, 1999

(30) Foreign Application Priority Data

Apr. 29, 1998 (SE) ..... 9801509

(51) Int. Cl.[7] ..... B31B 1/25

(52) U.S. Cl. ..... 495/59; 493/60; 493/63; 493/65

(58) Field of Search ..... 493/58, 59, 56, 493/60, 63, 65, 313, 316, 365, 160

(56) References Cited

U.S. PATENT DOCUMENTS

| | | | | | |
|---|---|---|---|---|---|
| 3,575,091 | A | * | 4/1971 | LaBantschnig | 198/803.5 |
| 3,882,765 | A | * | 5/1975 | Tokuno | 493/352 |
| 3,952,637 | A | * | 4/1976 | Lambert et al. | 493/30 |
| 4,003,300 | A | * | 1/1977 | Grobman | 493/365 |
| 4,033,217 | A | * | 7/1977 | Flaum et al. | 493/365 |
| 4,476,758 | A | * | 10/1984 | Coburn | |
| 4,620,826 | A | | 11/1986 | Rubio et al. | |
| 4,660,752 | A | | 4/1987 | Rikard et al. | |
| 5,057,068 | A | * | 10/1991 | Capdebosc | 493/355 |
| 5,316,538 | A | * | 5/1994 | Hill et al. | 493/355 |
| 5,344,377 | A | * | 9/1994 | Meeks | 493/368 |
| 5,509,352 | A | * | 4/1996 | Kowalewski et al. | 101/232 |
| 5,564,693 | A | * | 10/1996 | Elkis et al. | 198/689.1 |
| 5,827,162 | A | * | 10/1998 | Rubin et al. | 493/178 |
| 5,979,316 | A | * | 11/1999 | Baum | 101/216 |

FOREIGN PATENT DOCUMENTS

| | | |
|---|---|---|
| EP | 0114169 | 8/1984 |
| EP | 0752299 | 1/1997 |

* cited by examiner

*Primary Examiner*—Stephen F. Gerrity
*Assistant Examiner*—Louis Tran
(74) *Attorney, Agent, or Firm*—Sughrue Mion, PLLC

(57) ABSTRACT

Slitting unit forming part of a machine for production of carton blanks, in particular blanks made of cardboard or corrugated cardboard. The unit (2) comprises working wheels (12, 24, 25, 28) which are opposite in pairs, one wheel in at least one pair (24) being made with at least one slitting knife (26) extending over a part of the periphery of the wheel while the periphery of the other wheel in said pair is made with a slot for receiving the knife. The unit also comprises a vacuum belt (6) running adjacently to each slitting-wheel pair (24; 25) for securing and feeding the blanks (10). The wheels (24; 25) in each slitting-wheel pair are mounted in an upper and, respectively, a lower stand unit (3, 4) at least a portion of that part of one stand unit (4) which faces towards the other (3) being made in the form of a vacuum box. The vacuum belt (6) runs around this stand unit (4) and over the vacuum box, it being possible for the blanks (10) to be held fixed on the belt by the effect of suction from the vacuum box during transport through the slitting-wheel pair (24; 25).

6 Claims, 6 Drawing Sheets

SLITTING UNIT FOR CARTON BLANK PRODUCTION

The present invention relates to a slitting unit forming part of a machine for production of carton blanks, in particular blanks made of cardboard or corrugated cardboard, which unit comprises working wheels which are opposite in pairs, one wheel in at least one pair being made with at least one slitting knife extending over a part of the periphery of the wheel in said pair while the periphery of the other wheel is made with a slot for receiving the knife, and also members for feeding plane carton blanks between the wheels.

Slitting units of this type are used for providing carton blanks with slits which define foldable flaps which are required for the subsequent erection of the blank to form a carton. In this connection, the unit usually comprises a number of slitting-wheel pairs arranged one after the other and beside one another in order to produce both slits which are open towards the front and, respectively, rear edges of the blanks and slits which are separated in the lateral direction.

In conventional slitting units, the blanks are fed by means of the slitting wheels provided with knives and corresponding stay wheels made with pads, which requires the blanks to be clamped between the wheels.

In order to achieve the necessary friction against the blanks so that these are guided accurately, the blanks will be pressed together and deformed slightly by the slitting wheels. Furthermore, text and images which have been printed on the blank and have not dried may be smeared. In spite of strong contact against the blanks, there is still a risk of these being pulled through the unit at an angle.

In order to achieve the desired pressure against the carton blank, the slitting wheels in each pair must be height-adjusted depending on the thickness of the carton blank concerned, which is time-consuming and awkward. When the slitting wheels are used as feed wheels, their axes must be centred along the same vertical line, which means that the point where a knife cuts through the blank is located in the air in front of the point, the cutting point, where the knife meets the stay wheel. The distance to the cutting point increases as the blank thickness decreases.

As the slitting wheels are used as feed wheels, the smallest possible blank thickness is determined by the diameter of the wheels. As it is often desirable to combine slitting wheels with creasing wheels, a problem arises. For the creasing wheel, it is desirable to use as great a diameter as possible so as to reduce the velocity component in relation to the blank for points on the periphery of the creasing wheel in order thus to reduce the risk of obtaining a cutting effect instead of creasing. This results in the machine not being capable of handling small blanks as the wheels must then be positioned with a relatively great distance between axes seen in the direction of feed of the blanks.

The main object of the present invention is to produce a slitting unit in which inter alia the abovementioned disadvantages are eliminated.

In machines for production and handling of carton blanks, it is previously known to fix and feed the blanks in some handling stations by means of vacuum mats. This has previously not been possible in slitting units because inter alia the problem has not been solved of how the slitting knives are to be capable of cutting through a blank if it is located on a vacuum mat.

The present invention is based on the insight that it is possible to use vacuum technology for fixing and transporting carton blanks even in a slitting unit, provided that the vacuum mat is divided into a number of separate vacuum belts which are each supported by an associated stand unit.

In this connection, a slitting unit of the type indicated in the first paragraph is, according to the invention, characterized in particular in that it comprises a vacuum belt running adjacently to each slitting-wheel pair for securing and feeding the blanks, in that the wheels in each slitting-wheel pair are mounted in an upper and, respectively, a lower stand unit, in that at least a portion of that part of one stand unit which faces towards the other is made in the form of a vacuum box, and in that the vacuum belt runs around said one stand unit and over the vacuum box, it being possible for the blanks to be held fixed on the belt by the effect of suction from the vacuum box during transport through the slitting-wheel pair.

In a slitting unit of this type, no clamping of the carton blank between the slitting wheels is required, which means that a number of the abovementioned problems are eliminated. Nor is it necessary to perform any adjustment of the mutual distance of the slitting wheels in the vertical direction depending on the thickness of the carton blank concerned. Moreover, the slitting wheels in each pair can be displaced slightly relative to one another in the direction of feed of the blanks, which means that the cutting point can be adjusted so that, irrespective of the thickness of the blank concerned, it is located essentially in the lower delimiting surface of the blanks.

It is preferred that the slitting unit comprises a number of stand units arranged beside one another, with slitting-wheel pairs and vacuum belts, and that all the vacuum belts are driven synchronously with one another so as to form a common conveyor for the blanks. The stand units with their associated slitting wheels are suitably individually displaceable in a direction at right angles to the direction of feed of the blanks in order to allow adjustment of the positions of the slits depending on the size of the blanks.

Further features of a slitting unit according to the invention emerge from the patent claims below.

The invention will be described in greater detail below with reference to the embodiment shown by way of example in the appended drawings.

Figure 1:
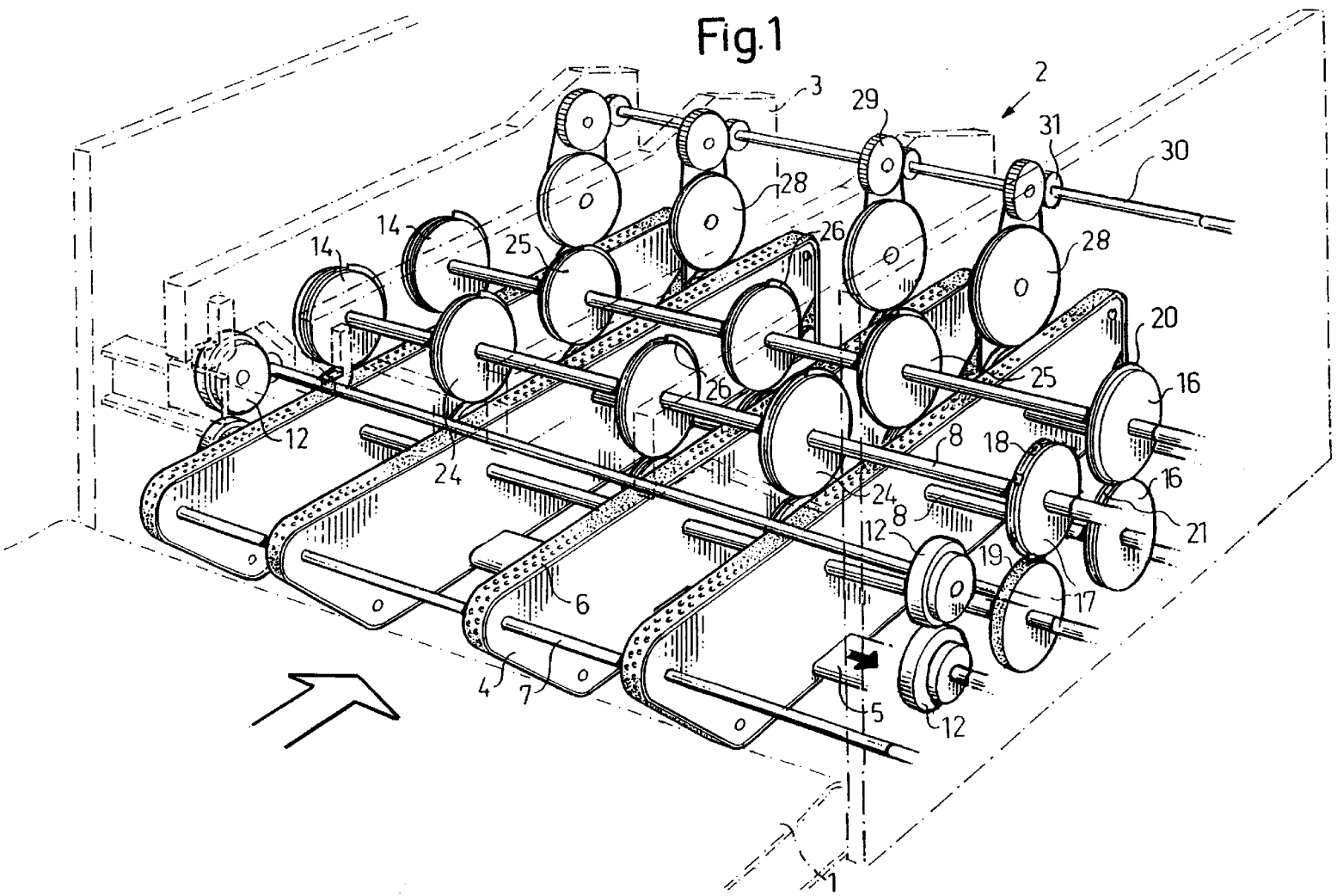
FIG. 1 is a diagrammatic perspective view of a slitting unit according to the invention.
Figure 2:
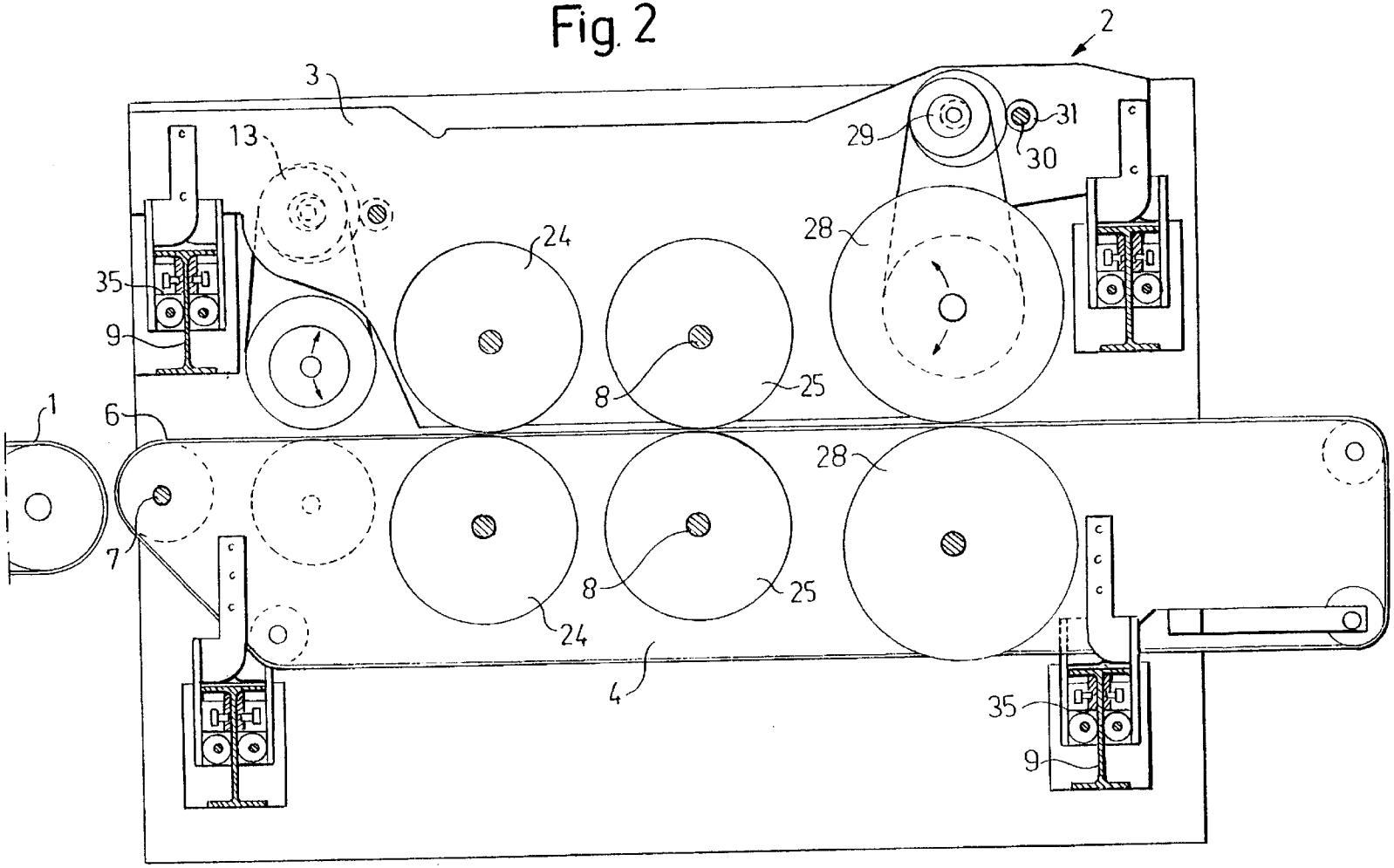
FIG. 2 is a side view of a pair of stand yokes with associated working wheels in the unit in FIG. 1.

In FIGS. 1 and 2, 1 indicates a conveyor track of optional type for feeding in plane blanks made of, for example, corrugated cardboard for working of these in a slitting unit 2 according to the present invention. The slitting unit comprises a number, four in the example shown, of pairs of upper and lower stand yokes 3 and 4 respectively located side by side, of which the upper yokes have been indicated only by means of dot/dash lines in FIG. 1. Mounted in each yoke are a number of working wheels one following another, the wheels mounted in the lower and, respectively, the upper yokes interacting in pairs to work a blank which passes between the wheels.

In the embodiment shown, the lower yokes 4 are made in the form of suction boxes with an internal negative pressure. To this end, the yokes have been connected to a vacuum blower or another vacuum source via a line 5. Each yoke 4 is provided with a conveyor belt 6 which runs around the yoke and is provided with a number of through-openings. At least the upper edge surfaces of the yokes 4, which surfaces interact with the belts 6, are made with openings so that the negative pressure in the suction boxes is conveyed via the openings in the belts 6 to produce a suction effect on a carton blank supported by the belts. Both the belts 6 and the various working wheels are driven from external drive sources by means of splined shafts 7 and, respectively, 8 which can be separated from the yokes or the working wheels so that the vacuum belts 6 can be mounted on the respective yoke 4 from the side. The yokes 4 thus perform two functions, on the one hand as stands for the working wheels and on the other hand as suction boxes for the vacuum belts 6.

The yokes 3 and 4 are suspended on transverse beams 9 via linear bearings 35, see FIG. 2, which allows the yokes to be displaced in the lateral direction relative to the direction of feed of the blanks for adaptation of the positions of the slits and the creases depending inter alia on the size of the blanks. In this connection, each pair of yokes can be displaced individually relative to the other yoke pairs. By means of the linear bearings 35, fine adjustment of the positions of the yokes is also possible, so that, for example, slits and creases run in the desired manner, for example in relation to the channels in a corrugated cardboard blank.

The slitting unit shown thus makes it possible for carton blanks to be fed through the various wheel pairs while they are held orientated exactly correctly on account of being fixed on the vacuum belts 6. This means inter alia that the wheels do not bring about any undesirable compression of the blanks or smearing of undried ink, which can occur in conventional slitting units in which the working wheels are also used as feed wheels for the blanks. Nor do the positions of the wheels in the respective pairs have to be adapted depending on the thickness of the blanks, and the cutting point can be adjusted so that it is located in the lower plane of the blanks, as will be described in greater detail below. The slitting unit described can also work very small blanks as these are transported on the vacuum belts 6 and are not subject to the diameters of the working wheels.

Figure 3:
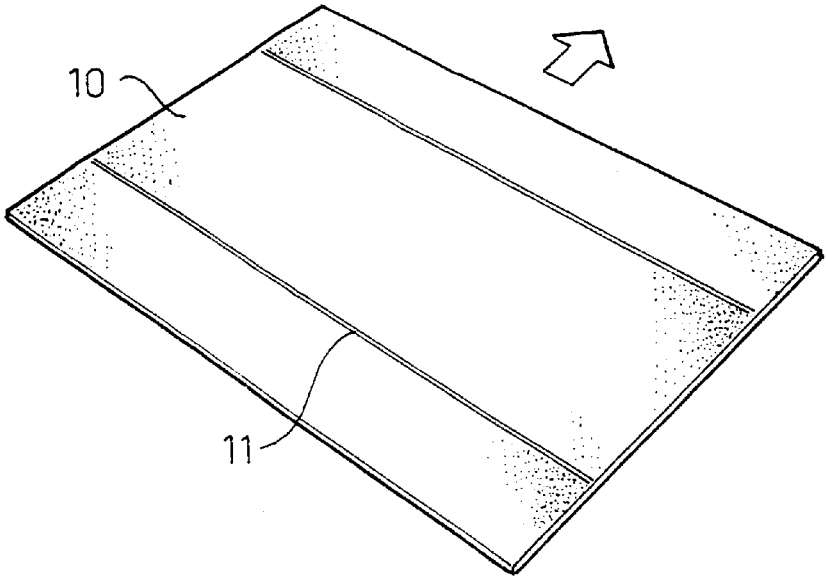
FIGS. 3 and 4 show the blank before and, respectively, after working in a slitting unit according to the invention.
Figure 5:
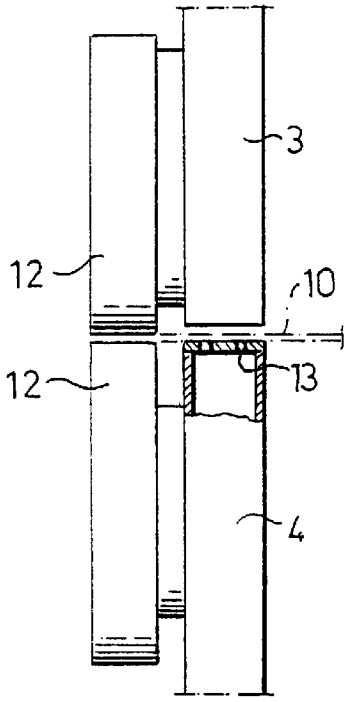
FIGS. 5–8 shows various pairs of wheels for working the edges of the blank.

The slitting unit shown in FIGS. 1 and 2 is intended to work the blanks 10 of the type illustrated in FIG. 3. In a preceding work station, the blanks have been provided with transverse creases 11 which may be required. In the case of corrugated cardboard blanks, the edge parts of the blanks are worked first by means of pairs of so-called crushing wheels 12, see also FIG. 5. As has been indicated in connection with the upper crushing wheel 12 in FIG. 2, this is connected to an eccentric arrangement 13 which can be used to adjust the final thickness of the edge parts of the blanks. The crushing wheels are driven by gear wheels inside the yokes.

Figure 9:
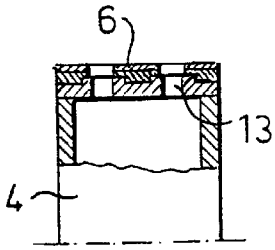
FIG. 9 shows the upper part of a suction box partly in section with the associated vacuum belt.

FIG. 9 shows that the lower yoke 4 is made in the form of a suction box with openings 13 in its upper edge surface. These openings interact with openings in the vacuum belt 6 running over them to secure a blank.

Figure 4:
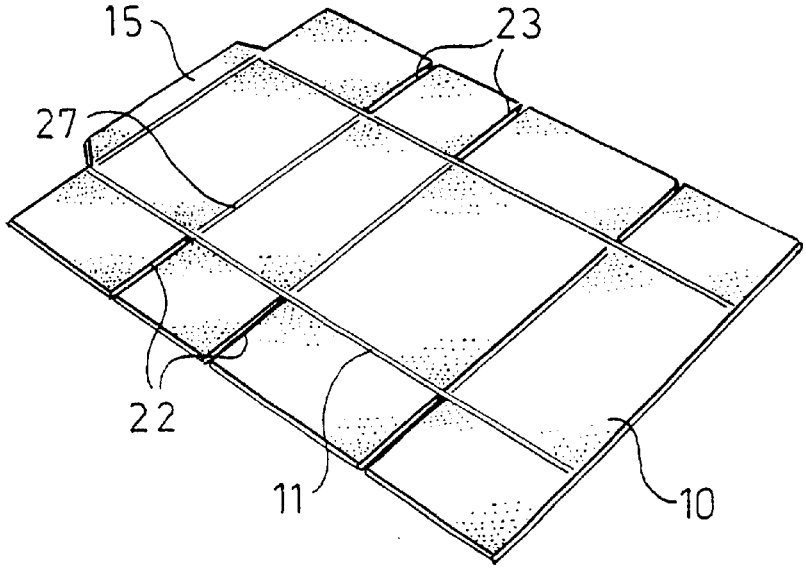

The left edge of the blank 10 shown in FIG. 3 is then worked by two cutting wheel pairs 14 which cut out a gluing flap 15 in the blank, see FIG. 4.

Figure 6:
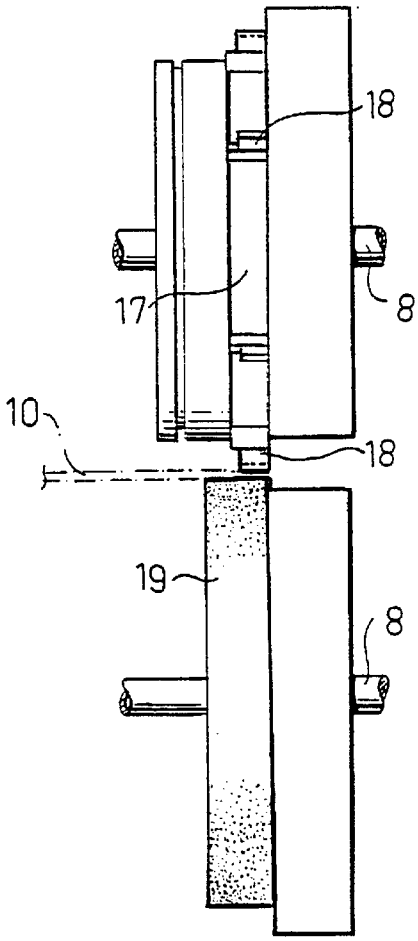
Figure 7:
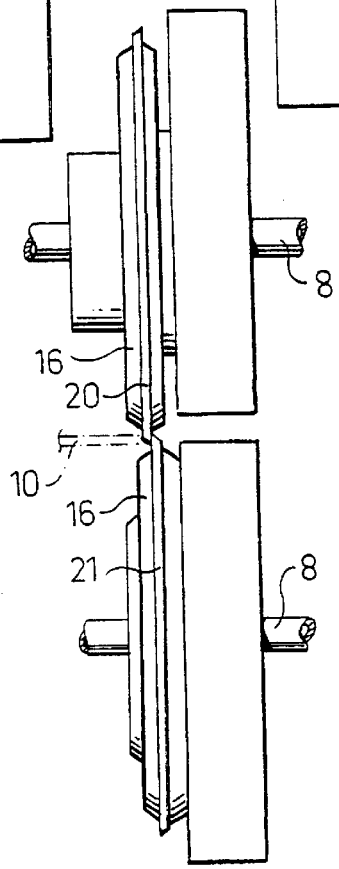

The right edge of the blank in FIG. 3 is trimmed by means of a wheel pair 16 which is preceded by a wheel pair 17 which serves as a so-called trimming crusher and cuts off the strip which is separated by the wheels 16 in short pieces. The wheels 17 in the trimming crusher are shown in FIG. 6, 18 indicating transverse knives and 19 a stay pad. The wheels 16 with interacting trimming knives 20, 21 are shown in FIG. 7.

Figure 10:
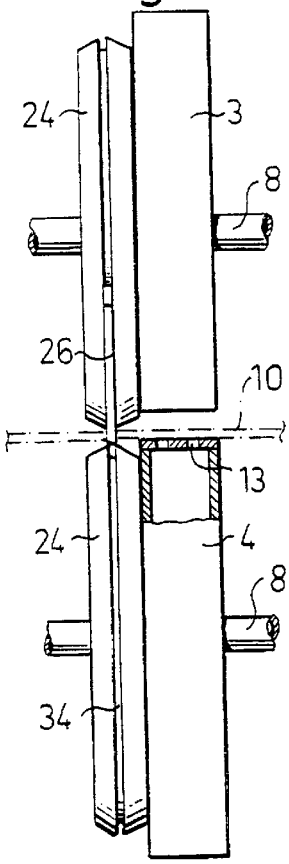
FIG. 10 shows a pair of wheels for producing slits in the blank.
Figure 8:
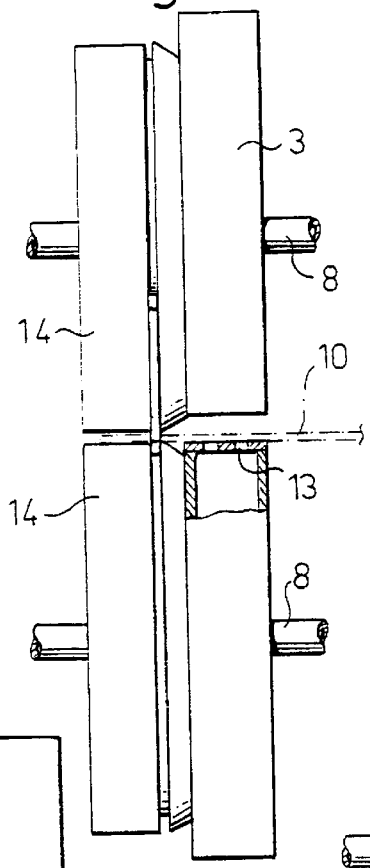

To produce the three rearwardly open slits 22 and, respectively, the three forwardly open slits 23 in the blank 10, see FIG. 4, use is made of three first 24 and three second 25 pairs of slitting wheels. In this connection, the upper wheel in each pair is provided with a knife 26 which runs over a length of the periphery of the wheel corresponding to the length of the desired slit in the blank 10. The lower wheel in each slitting-wheel pair is made with a corresponding slot 34 for receiving the knife 26, see FIG. 10.

For the erection of the blank shown in FIG. 4 to form a carton, the blank must also be provided with longitudinal creases 27 between the slits 22 and 23. To this end, the slitting unit in FIGS. 1 and 2 is completed by four pairs of creasing wheels 28, see also FIG. 11. Each of the upper creasing wheels is connected to an eccentric arrangement 29 driven by a drive shaft 30 via a gear wheel 31. The eccentric arrangement 29 is used to adjust the contact pressure of the creasing wheels against the blank passing through. The creasing wheels are driven via gear wheels inside the yokes.

Figure 11:
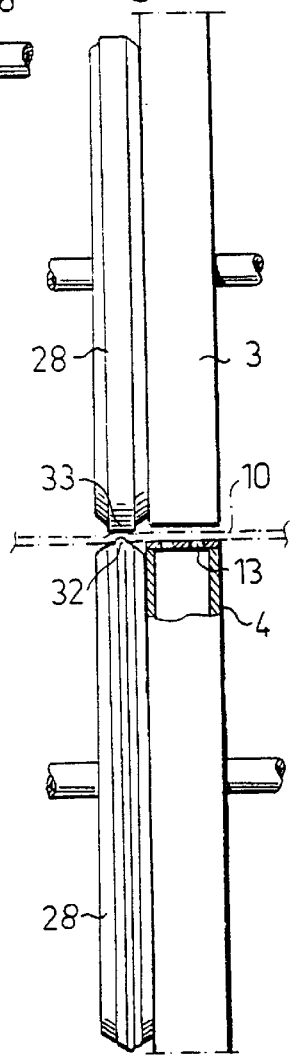
FIG. 11 shows a pair of wheels for producing creases in the blank which are located essentially in line with the slits.

As can be seen from FIG. 11, the lower creasing wheel 28 is provided with a circumferential rim 32 which produces the crease in the blank 10 by interacting with a plane pad 33 of the upper creasing wheel 28. The lower creasing wheel can be mounted in such a manner that it can be displaced slightly in the lateral direction relative to the yoke 4 to adjust the position of the crease in relation to the slits in the blank.

The slitting unit described above thus produces a carton blank according to FIG. 4 which is then conveyed to a work station in which the necessary handle openings are punched out in the blank.

Figure 12:
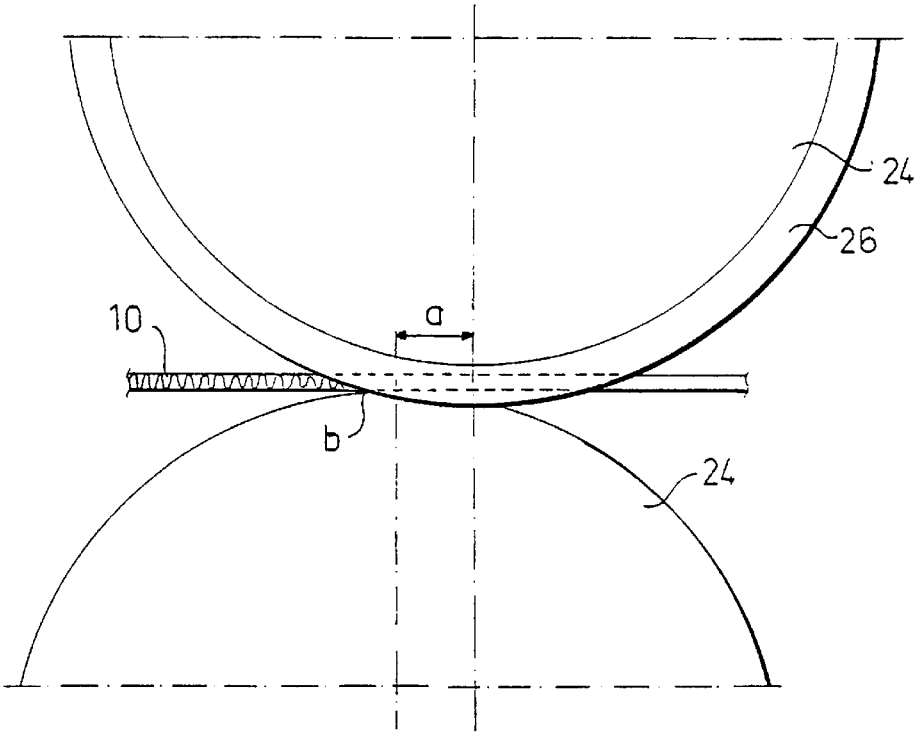
FIG. 12 illustrates the position of the cutting point when the present invention is implemented.

A further advantage of feeding the blanks by means of vacuum belts instead of using working wheels as feed wheels is illustrated in FIG. 12. As can be seen from this figure, the upper slitting wheel 24 with its knife 26 is displaced by a distance a in the direction of feed of the blank 10 in relation to the lower wheel 24 serving as a stay. This means that the cutting point b, that is to say the point where the knife 26 meets the stay wheel, is located essentially in the lower delimiting surface of the blank. The blank is thus supported by the stay wheel 24 when the knife cuts through the blank. In this connection, as can be seen, the periphery of the upper slitting wheel 24 does not make contact with the blank 10 and the distance between the upper and the lower slitting wheel does not have to be adapted depending on the thickness of the blank.

Figure 13:
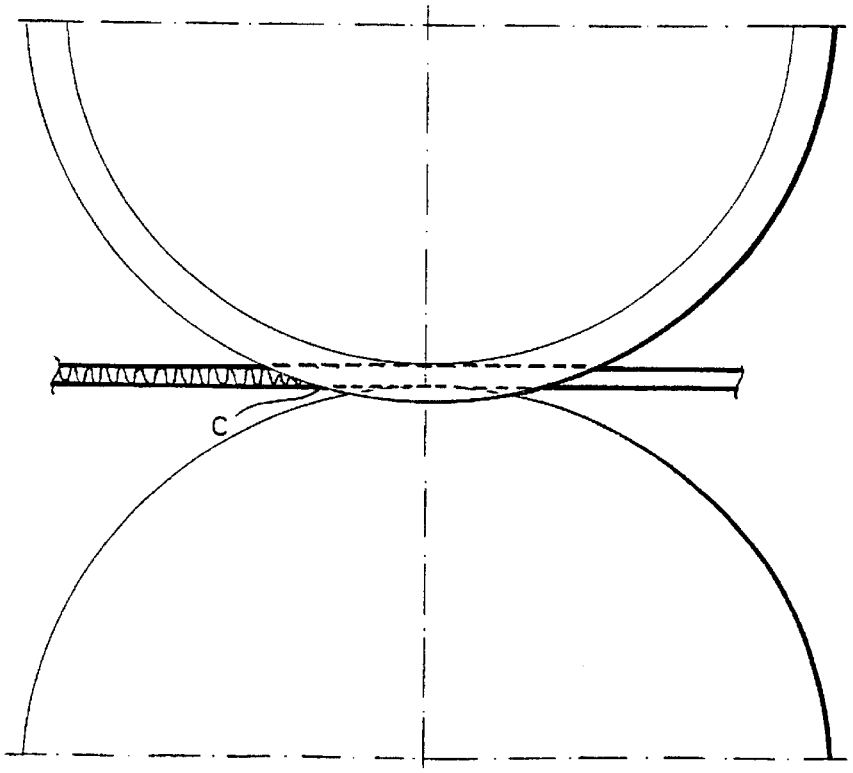
FIG. 13 illustrates the position of the cutting point in the case of conventional slitting wheels.

In conventional slitting units in which the slitting wheels are also used for feeding the blanks, the cutting-through point c of the knife 26 is, see FIG. 13, located in the air in front of the stay wheel. As the blank then lacks a stay when the knife cuts through the blank, it is bent downwards slightly and inter alia impairs the accuracy of the position of the slit. The thinner the blank, the further the cutting-through point of the knife is displaced from the stay wheel 24.

The invention has been described above in connection with the embodiment shown by way of example in the drawings. However, it may be varied in a number of respects within the scope of the patent claims below. For example, the number and embodiment of the various working wheels in the slitting unit can be varied as required. The shape of the yokes made in the form of suction boxes can also be changed as can the drives and mutual connections of the working wheels.

What is claimed is:

1. A slitting unit forming part of a machine for production of carton blanks, the slitting unit (2) comprising:

working wheels (12, 24, 25, 28) disposed in opposing pairs, one wheel in at least one pair (24) being made with at least one slitting knife (26) extending over a part of the periphery of the wheel while the periphery of the other wheel in said pair is made with a slot (34) for receiving the knife; and members (6), for feeding plane carton blanks (10) between the wheels, comprising a vacuum belt (6) running adjacently to each slitting-wheel pair (24; 25) for securing and feeding the blanks (10), wherein the wheels (24, 25) in each slitting-wheel pair are mounted in an upper and respectively, a lower stand unit (3, 4), wherein at least a portion of a part of one (4,3) of said upper and lower stand units which faces towards another one (3,4) of said upper and lower stand units is made in the form of a vacuum box, and further wherein the vacuum belt (6) runs around said one (4, 3) of said upper and lower stand units and over the vacuum box forming part of said one (4, 3) of said upper and lower stand units, it being possible for the blanks (10) to be held fixed on the belt by the effect of suction form the vacuum box during transport through the slitting wheel pair (24, 25), wherein a number of stand units (3, 4) are arranged beside one another, with slitting-wheel pairs (24; 25) and vacuum belts (6), and wherein all the vacuum belts are driven synchronously with one another so as to form a common conveyor for the blanks (10), and further wherein the slitting wheels (24; 25) are mounted in the stand units (3, 4) in such a manner that the vacuum belts (6) can be slipped onto the respective stand unit from a side thereof.

2. A slitting unit forming part of a machine for production of carton blanks, the slitting unit (2) comprising:

working wheels (12, 24, 25, 28) disposed in opposing pairs, one wheel in at least one pair (24) being made with at least one slitting knife (26) extending over a part of the periphery of the wheel while the periphery of the other wheel in said pair is made with a slot (34) for receiving the knife; and members (6), for feeding plane carton blanks (10) between the wheels, comprising a vacuum belt (6) running adjacently to each slitting-wheel pair (24; 25) for securing and feeding the blanks (10), wherein the wheels (24, 25) in each slitting-wheel pair are mounted in an upper and, respectively, a lower stand unit (3, 4), wherein at least a portion of a part of one (4,3) of said upper and lower stand units which faces towards another one (3,4) of said upper and lower stand units is made in the form of a vacuum box, and further wherein the vacuum belt (6) runs around said one (4, 3) of said upper and lower stand units and over the vacuum box forming part of said one (4, 3) of said upper and lower stand units, it being possible for the blanks (10) to be held fixed on the belt by the effect of suction form the vacuum box during transport through the slitting wheel pair (24, 25), wherein the stand units (3, 4) with their associated slitting wheels (24; 25) are individually displaceable in a direction at right angles to the direction of feed of the blanks (10).

3. The slitting unit according to claim 2, wherein the lower stand unit (4) is made in the form of a vacuum box, and further wherein the upper portion of the vacuum box, which faces towards the stand unit (3) lying above, is provided with suction openings (13) which interact with openings in the vacuum belt (6).

4. The slitting unit according to claim 2, wherein the wheel (24; 25) provided with the knife is located at such a height above the blanks (10) that the peripheral surface of the wheel at a side of the knife does not make contact with the blanks.

5. A slitting unit forming part of a machine for production of carton blanks, the slitting unit (2) comprising:

working wheels (12, 24, 25, 28) disposed in opposing pairs, one wheel in at least one pair (24) being made with at least one slitting knife (26) extending over a part of the periphery of the wheel while the periphery of the other wheel in said pair is made with a slot (34) for receiving the knife; and members (6), for feeding plane carton blanks (10) between the wheels, comprising a vacuum belt (6) running adjacently to each slitting-wheel pair (24; 25) for securing and feeding the blanks (10), wherein the wheels (24, 25) in each slitting-wheel pair are mounted in an upper and, respectively, a lower stand unit (3, 4), wherein at least a portion of a part of one (4,3) of said upper and lower stand units which faces towards another one (3,4) of said upper and lower stand units is made in the form of a vacuum box, and further wherein the vacuum belt (6) runs around said one (4, 3) of said upper and lower stand units and over the vacuum box forming part of said one (4, 3) of said upper and lower stand units, it being possible for the blanks (10) to be held fixed on the belt by the effect of suction form the vacuum box during transport through the slitting wheel pair (24, 25), and further wherein the slitting wheels (24; 25) in each pair are displaced slightly relative to one another in the direction of feed of the blanks (10) so that a cutting point (b) is located essentially in the lower delimiting surface of the blanks.

6. A slitting unit forming part of a machine for production of carton blanks, the slitting unit (2) comprising:

working wheels (12, 24, 25, 28) disposed in opposing pairs, one wheel in at least one pair (24) being made with at least one slitting knife (26) extending over a part of the periphery of the wheel while the periphery of the other wheel in said pair is made with a slot (34) for receiving the knife; and members (6), for feeding plane carton blanks (10) between the wheels, comprising a vacuum belt (6) running adjacently to each slitting-wheel pair (24; 25) for securing and feeding the blanks (10), wherein the wheels (24, 25) in each slitting-wheel pair are mounted in an upper and, respectively, a lower stand unit (3, 4), wherein at least a portion of a part of one (4,3) of said upper and lower stand units which faces towards another one (3,4) of said upper and lower stand units is made in the form of a vacuum box, and further wherein the vacuum belt (6) runs around said one (4, 3) of said upper and lower stand units and over the vacuum box forming part of said one (4, 3) of said upper and lower stand units, it being possible for the blanks (10) to be held fixed on the belt by the effect of suction form the vacuum box during transport through the slitting wheel pair (24, 25), and further wherein the stand units (3, 4,) bear, in addition to slitting-wheel pairs (24; 25), wheel pairs (16, 14) for trimming the edges of the blanks (10) and cutting out gluing flaps (15), said vacuum belts (6) also being used for feeding the blanks between these wheel pairs.

* * * * *